US008651312B2

(12) United States Patent
Minnette

(10) Patent No.: US 8,651,312 B2
(45) Date of Patent: Feb. 18, 2014

(54) CANISTER

(75) Inventor: Jeffrey C. Minnette, Evansville, IN (US)

(73) Assignee: Berry Plastics Corporation, Evansville, IN (US)

( * ) Notice: Subject to any disclaimer, the term of this patent is extended or adjusted under 35 U.S.C. 154(b) by 0 days.

(21) Appl. No.: 13/441,488

(22) Filed: Apr. 6, 2012

(65) Prior Publication Data

US 2012/0305560 A1 Dec. 6, 2012

Related U.S. Application Data

(60) Provisional application No. 61/473,624, filed on Apr. 8, 2011.

(51) Int. Cl.

| | |
|---|---|
| ***B65D 41/02*** | (2006.01) |
| ***B65D 41/16*** | (2006.01) |
| ***B65D 41/18*** | (2006.01) |
| *B65D 17/52* | (2006.01) |

(52) U.S. Cl.
USPC ..... 220/260; 220/284; 220/285; 220/790; 220/792; 220/795

(58) Field of Classification Search
USPC ..... 220/260, 284, 285, 286, 733, 735, 736, 220/790, 792, 795
See application file for complete search history.

(56) References Cited

U.S. PATENT DOCUMENTS

| | | | | |
|---|---|---|---|---|
| 3,515,306 | A * | 6/1970 | Roper et al. | 220/792 |
| 4,166,548 | A * | 9/1979 | Crisci | 220/795 |
| 5,143,219 | A * | 9/1992 | Yates, Jr. | 206/508 |
| 5,307,949 | A * | 5/1994 | Von Holdt, Jr. | 220/276 |
| 6,845,877 | B2 * | 1/2005 | Diesterbeck | 220/782 |
| 6,880,716 | B2 * | 4/2005 | Gottainer et al. | 220/284 |

* cited by examiner

*Primary Examiner* — Anthony Stashick
*Assistant Examiner* — Madison L Poos
(74) *Attorney, Agent, or Firm* — Barnes & Thornburg LLP

(57) ABSTRACT

A canister includes a container and a lid that is able to be coupled to the container. The container includes a bottom wall and a side wall formed to include a mouth opening into a product-receiving chamber. The container includes an annular side wall that is formed to include a neck finish. The neck finish is configured to accept the lid of the canister.

34 Claims, 10 Drawing Sheets

CANISTER

PRIORITY CLAIM

This application claims priority under 35 U.S.C. §119(e) to U.S. Provisional Application Ser. No. 61/473,624, filed Apr. 8, 2011, which is expressly incorporated by reference herein.

BACKGROUND

The present disclosure relates to canisters, and particularly to injection molded canisters provided with a container and a lid fitted onto the container. More particularly, the present disclosure relates to the sealing arrangement between the lid and container. The current all-plastic paint packages leak due to assembly issues, tolerances of the manufacturing process and contamination of the sealing surfaces with paint.

SUMMARY

A canister in accordance with the present disclosure includes a container and a lid that can be removably coupled to the container.

In illustrative embodiments, the canister includes the container, the lid, and opening devices which contain sealing and drip-less pouring features. The canister is suitable for use as a liquid or gas tight sealing canister. The lid includes a sealing gasket/caulking which is configured to seal against a neck finish of the container to seal contents that are under high temperature and high pressure and prevent leaking of canister contents during extreme shaking or rotation of the canister.

Additional features of the disclosure will become apparent to those skilled in the art upon consideration of the following detailed description of illustrative embodiments exemplifying the best mode of carrying out the disclosure as presently perceived.

BRIEF DESCRIPTION OF THE DRAWINGS

The detailed description particularly refers to the accompanying figures in which.

DETAILED DESCRIPTION

Figure 1:
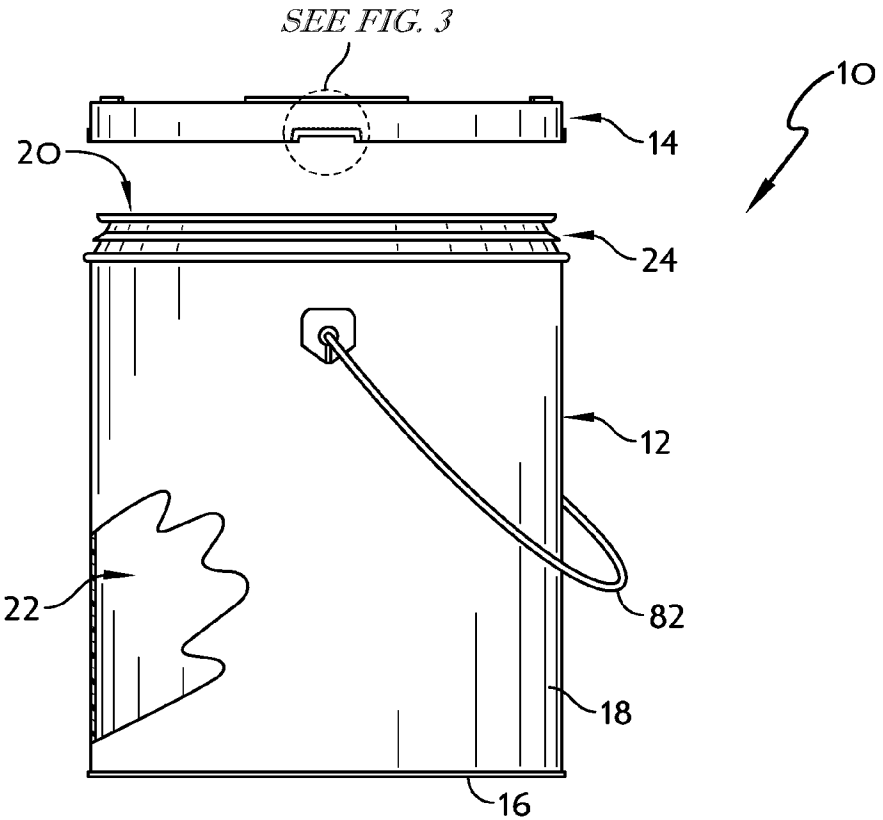
FIG. 1 is a side elevational view of the canister showing a container and a lid positioned over the container, the container having a neck finish configured to accept the lid.

A canister 10 includes a container 12 and a lid 14 configured to be removably coupled to container 12. Container 12 is provided with a bottom wall 16 and a side wall 18 formed to include a mouth 20 opening into a product-receiving chamber 22 of container 12, as shown for example, in FIG. 1. Container 12 includes annular side wall 18 that is formed to include a neck finish 24. Neck finish 24 is configured to accept lid 14 of canister 10.

Figure 2:
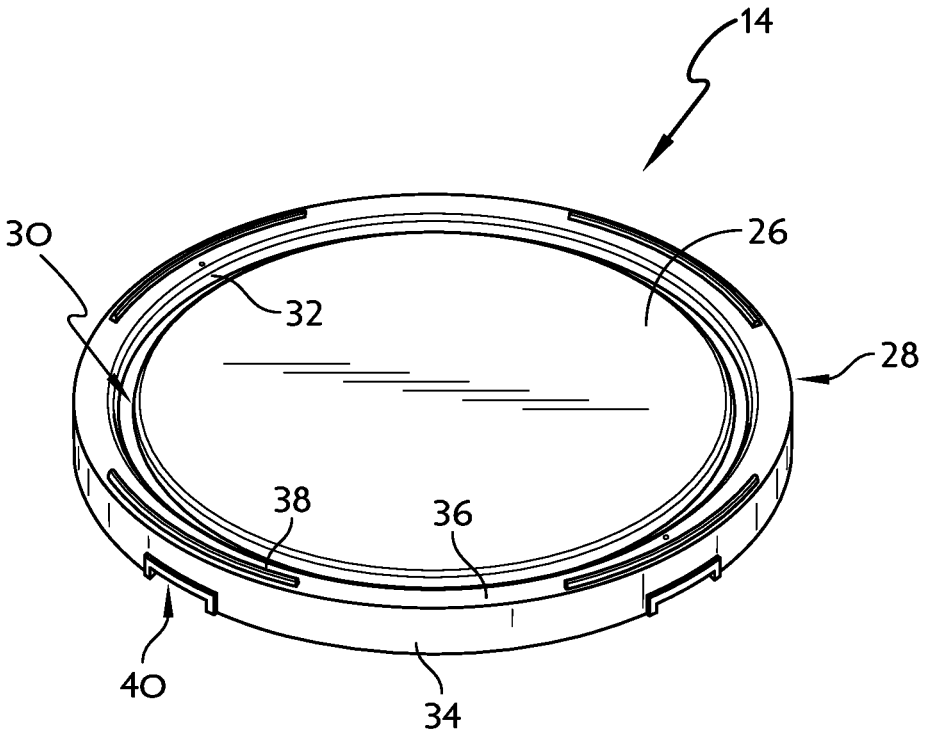
FIG. 2 is a perspective view of the lid showing a top wall and an annular side wall, the side wall formed to include a series of recesses at a lower edge to allow for insertion of a tool to remove the lid from the container.

Lid 14 is configured to be coupled to neck finish 24 to seal mouth 20 of container 12, as shown, for example in FIGS. 1 and 2. Lid 14 includes a top wall 26, and an annular rim 28 extending around the perimeter of lid 14. Top wall 26 and rim 28 are separated by an annular groove 30. Annular groove 30 is defined by inner wall 32, top wall segment 42 and channel wall segment 44.

Figure 3:
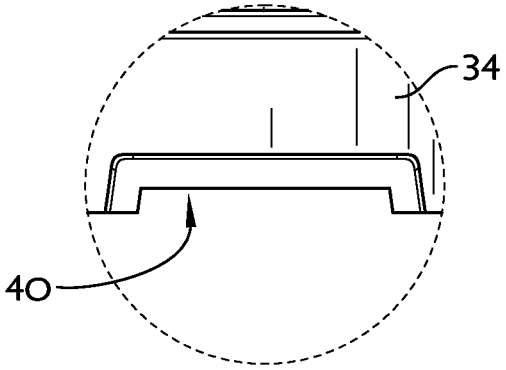
FIG. 3 is an enlarged view of a portion of the lid of FIG. 2 showing the recess formed in the annular side wall.
Figure 4:
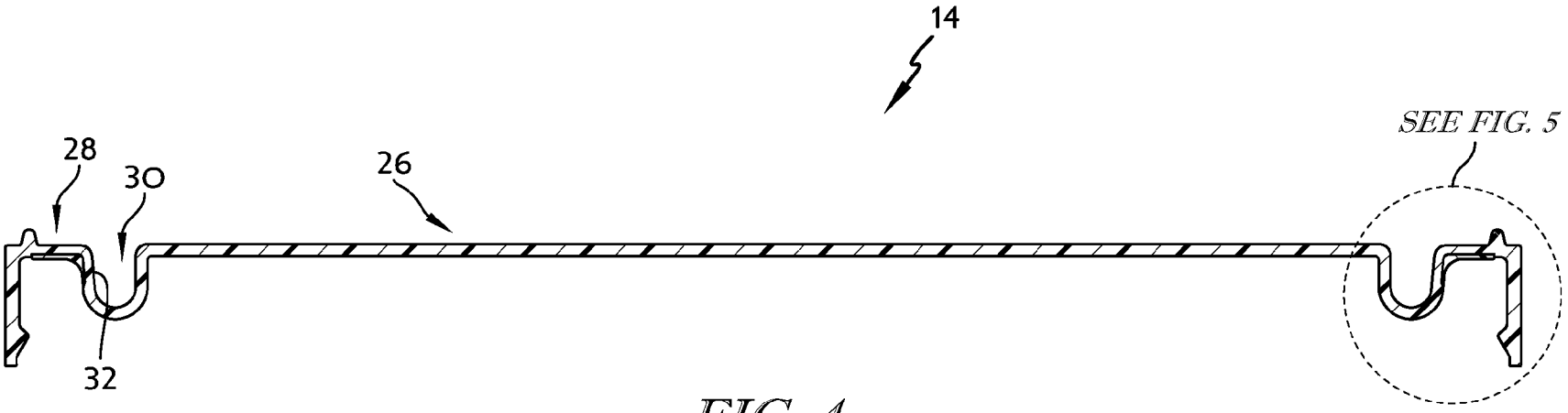
FIG. 4 is a sectional view taken along line 4-4 of FIG. 2 showing the top wall and the annular side wall.
Figure 5:
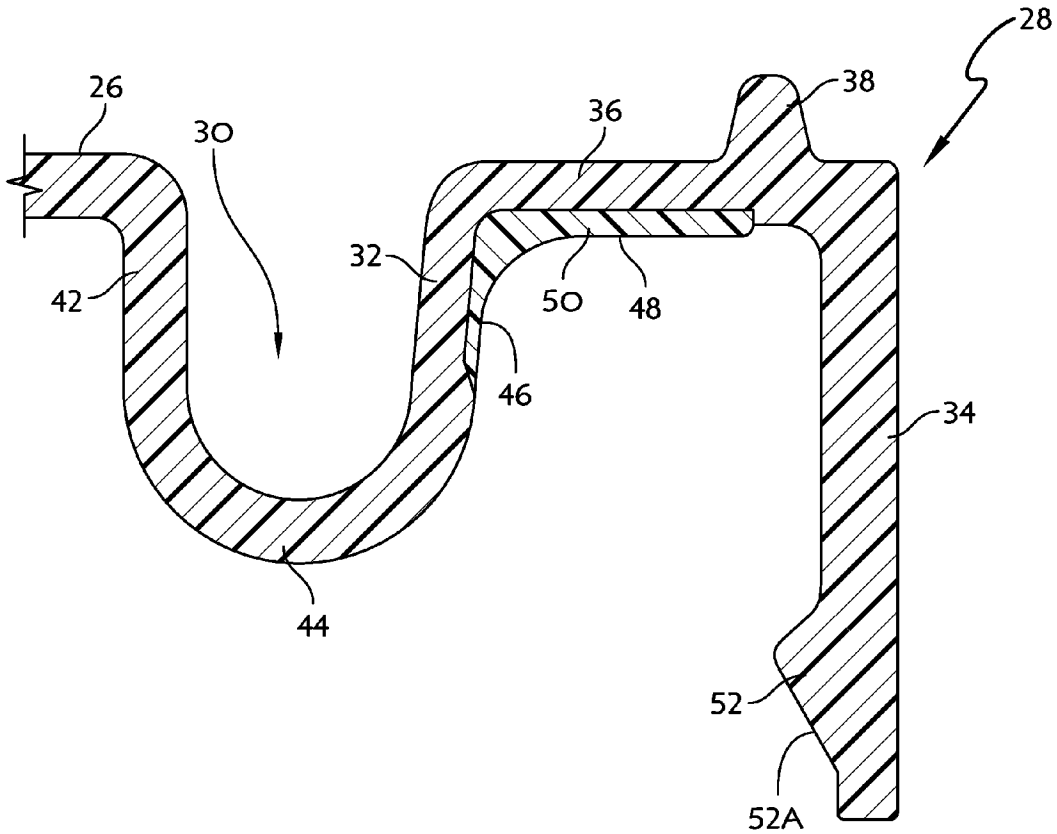
FIG. 5 is an enlarged view of a portion of the lid of FIG. 4 showing the rim of the lid having an inner wall, an outer wall and an upper wall positioned between the inner and outer walls and also showing gasket material formed on the inner and upper walls of the rim.

Annular rim 28 of lid 14 includes an inner wall 32, an outer wall 34 and an upper wall 36 positioned between inner and outer walls 32, 34, as shown in FIG. 2. Upper wall 36 includes a series of upwardly extending ribs 38 to permit stacking of multiple canisters 10. Outer wall 34 is formed to include a series of cut-outs 40, as shown, for example, in FIGS. 2 and 3. Cut-outs 40 permit the insertion of a pry tool beneath outer wall 34 of annular rim 28 and container 12 to allow lid 14 to be pried from container 12.

Inner wall 32 of annular rim 28 is generally perpendicular to upper wall 36 and includes a first sealing surface 46 that is configured to engage and seal with neck finish 24 of container 12 to form a first seal. Upper wall 36 includes a second sealing surface 48 that is configured to engage and seal with neck finish 24 to form a second seal. Inner and upper walls 32, 36 may include a gasket 50. Gasket 50 can be used to form sealing surfaces 46, 48 and can be injection molded onto lid 14.

Outer wall 34 of annular rim 28 is generally perpendicular to upper wall 36 and extends downwardly from upper wall 36 toward container 12. Outer wall 34 includes inwardly extending bead segments 52 that are positioned proximate a lower end of outer wall 34. Bead segments 52 are positioned proximate cut-outs 40 in outer wall 34 to facilitate removal of lid 14 from container 12. Using a pry tool 80 within a selected cut-out 40 allows outer wall 34 to flex outwardly freeing a bead segment 52 from neck finish 24 of container 12.

Figure 6:
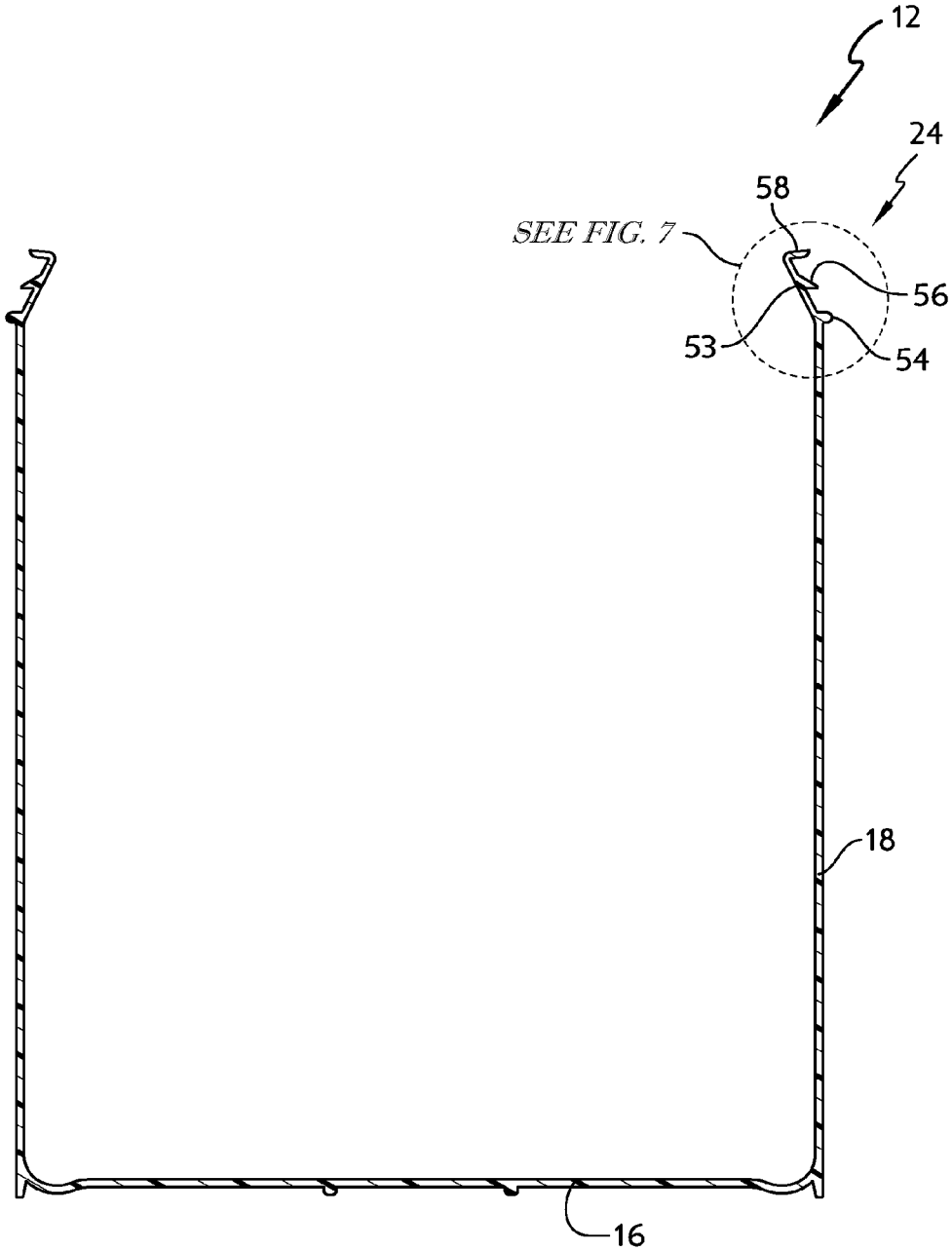
FIG. 6 is a sectional view of the container taken along line 6-6 of FIG. 1 showing a bottom wall, a side wall having a mouth opening into a product receiving chamber, the side wall having a neck finish configured to accept the lid.
Figure 7:
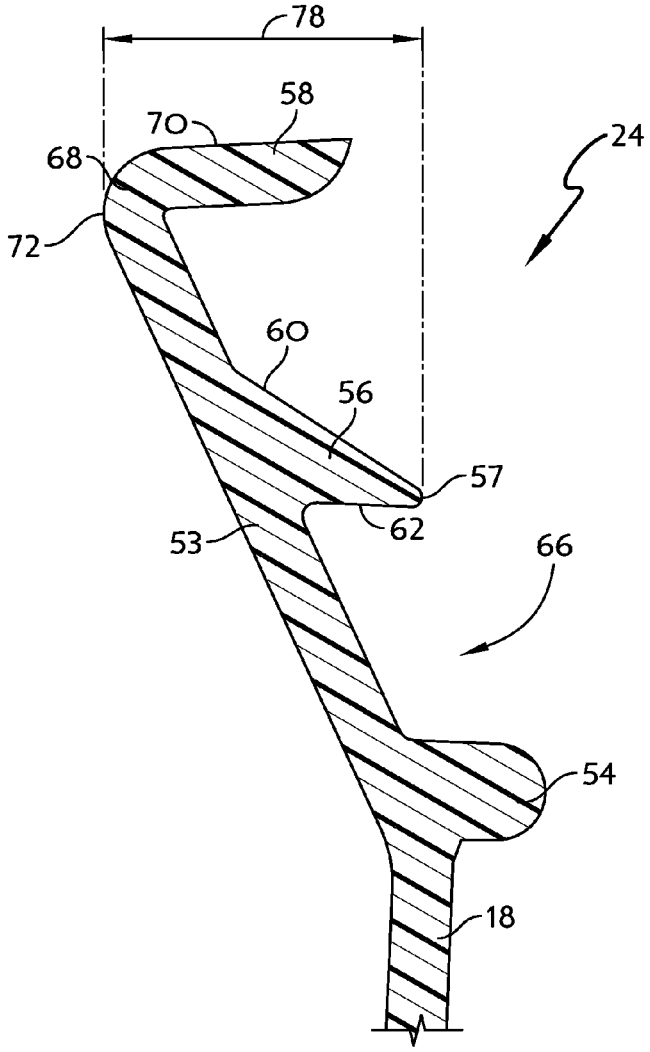
FIG. 7 is an enlarged view of the neck finish of FIG. 6 showing an inclined wall having an outwardly extending annular flange that extends at about the midpoint of the inclined wall and an outwardly extending annular lip.

Container 12 includes neck finish 24 that is configured to engage and seal with annular rim 28 of lid 14, as shown in FIGS. 6 and 7. Neck finish 24 includes an inclined annular wall 53 having an outwardly extending annular bead 54, an outwardly extending lock flange 56 and an outwardly extending lip 58. Lock flange 56 and lip 58 are configured to interact with annular rim 28 of lid 14 to seal and retain lid 14 on container 12.

Lock flange 56 extends outwardly from inclined wall 53 and includes a sloped surface 60 and a lock surface 62. Sloped surface 60 is configured to engage sloped surface 52A of bead segments 52 to cam out outer wall 34 of annular rim 28 when lid 14 is pressed onto container 12. Lock flange 56, annular bead 54 and inclined wall segment 64 together form bead-retention groove 66. Lock surface 62 of lock flange 56 is configured to engage and retain the position of bead segments 52 within bead-retention groove 66 until a user pries bead segments 52 past lock flange 56 by inserting a pry tool into cut-out 40 of outer wall 34. Lock flange 56 also includes an end wall 57.

Lip 58 of neck finish 24 is coupled to inclined wall 53 at elbow 68 and extends outwardly from inclined wall 53, as shown in FIG. 7. Elbow 68 creates a spring bias to bias lip 58 slightly upwardly from horizontal. Lip 58 forms a first sealing surface 70 that is configured to engage second sealing surface 48 of upper wall 36 of annular rim 28. Elbow 68 includes a outer surface that forms a second sealing surface 72. Second sealing surface is configured to engage first sealing surface 46 of inner wall 32 of annular rim 28. Lip 58 of neck finish 24 creates a pour stop to prevent unwanted drips when pour contents from container 12. This pour stop is beneficial when paint or other liquids are poured from container 12.

Figure 8:
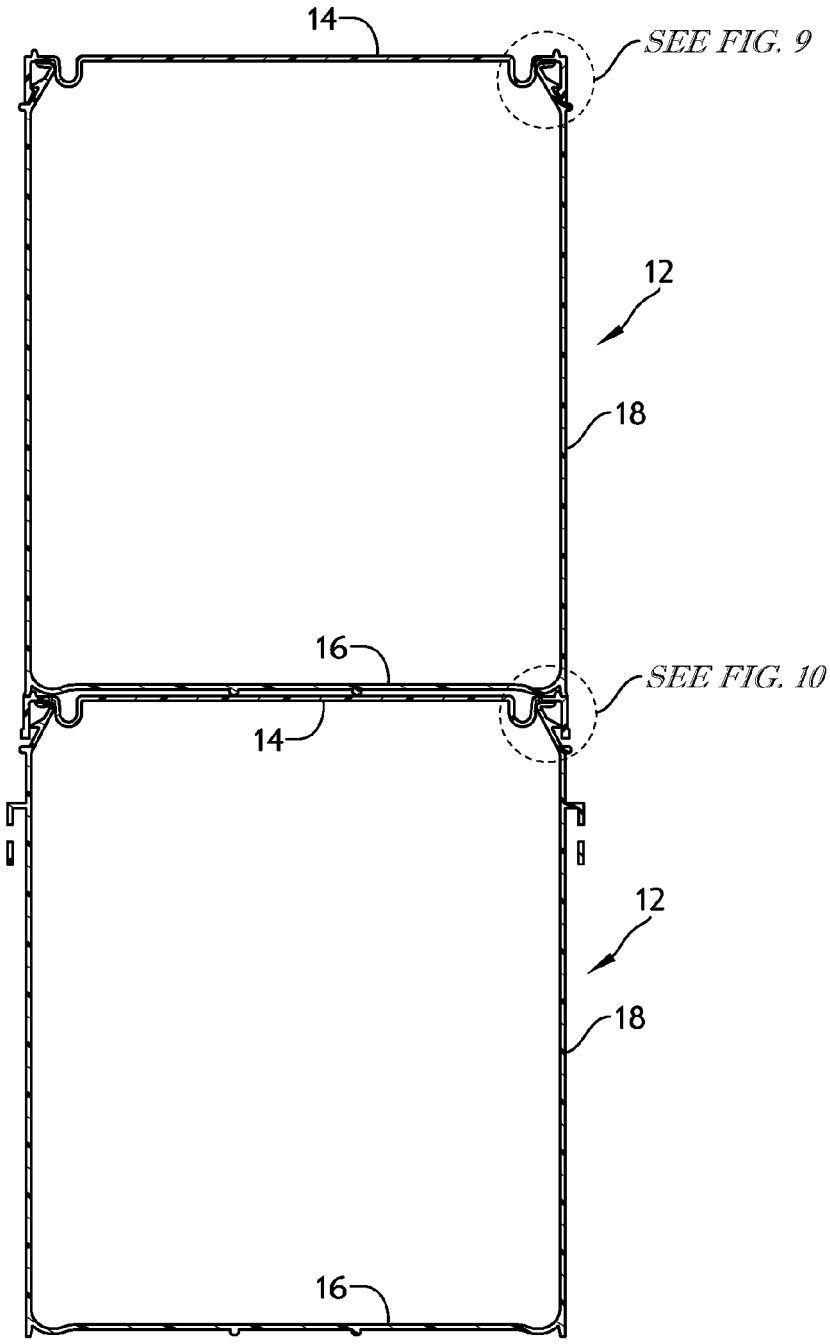
FIG. 8 is a cross sectional view of two canisters with one canister stacked upon the lid of the other canister.
Figure 10:
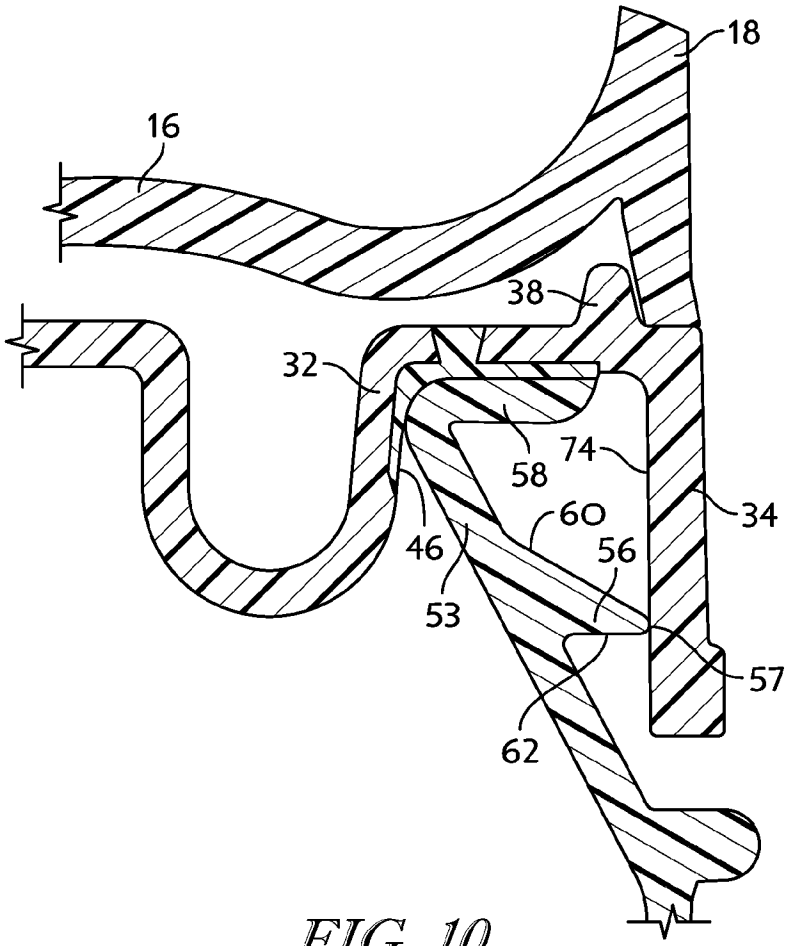
FIG. 10 is an enlarged cross sectional view of FIG. 8 showing the stacking of one container upon the lid of another container.
Figure 9:
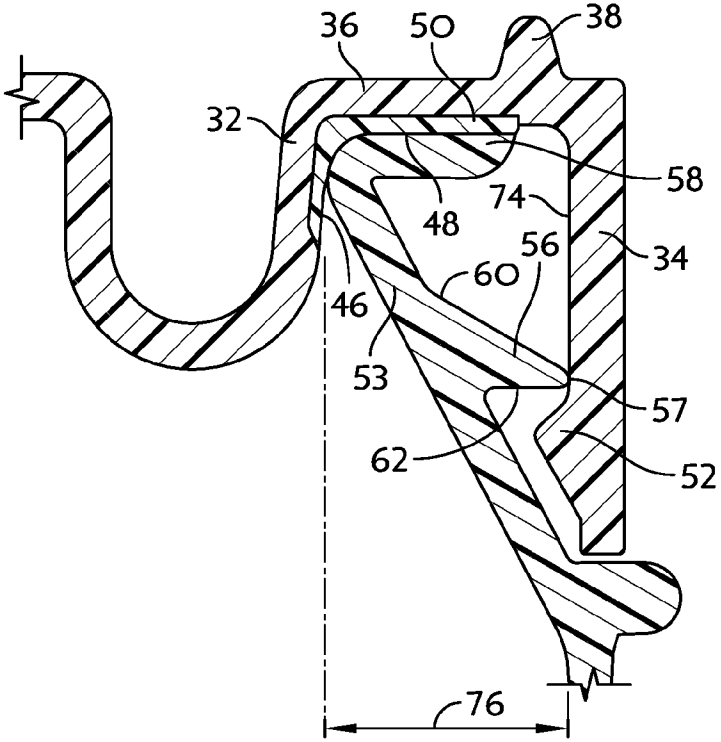
FIG. 9 is an enlarged cross sectional view of FIG. 8 showing the interaction between the rim of the lid and the neck finish of the container.
Figure 11:
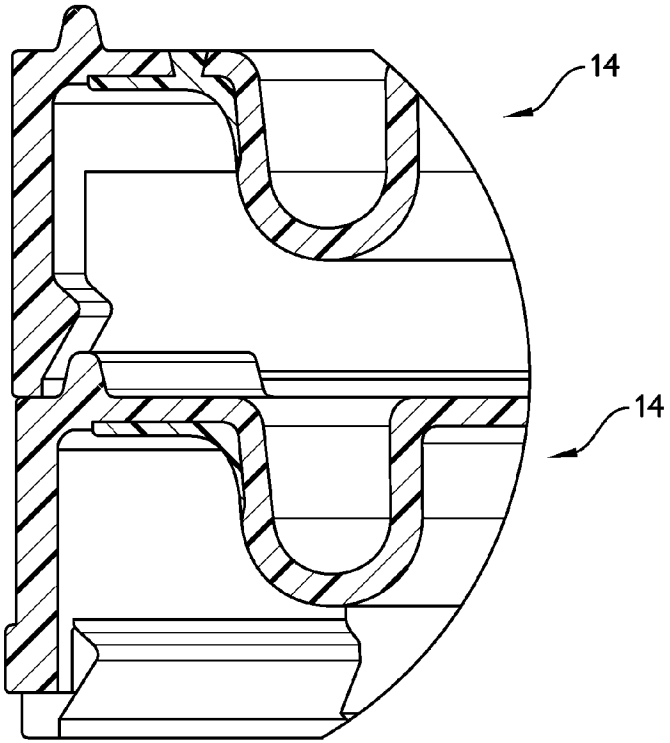
FIG. 11 is a cross sectional view of two lids showing the stacking and anti-nesting features of the lid.

The interaction of lid 14 with neck finish 24 of container 12 is illustrated in FIGS. 8 and 9. When lid 14 is coupled to container 12, bead segments 52 are positioned within bead-retention groove 66 to secure lid 14 to container 12. With bead segments 52 positioned within bead-retention groove 66, lip 58 is positioned against upper wall 36 and elbow 68 is positioned against inner wall 32 of annular rim 28.

When lid 14 is installed on container 12, first sealing surface 70 comes into contact with and is biased toward second sealing surface 48 formed by gasket 50. In order to slip bead segments 52 past lock flange 56, lip 58 flexes downward about elbow 68. This downward movement creates a biasing force on lip 58 to form a positive seal between second sealing surface 48 of gasket 50 and first sealing surface 70 of lip 58.

With lid 14 installed on container 12 inner surface 74 of outer wall 34 engages end wall 57 of lock flange 56 to cause second sealing surface 72 to engage firmly against first sealing surface 46 of inner wall 32 of annular rim 28. The width 76 of annular rim 28 is less than the width 78 of the distance between elbow 68 and lock flange 56, as shown in FIGS. 7 and 9. This arrangement causes outer wall 34 of annular rim 28 and inclined wall 53 to flex slightly to cause elbow 68 to be forced into first sealing surface 46 to form an air-tight seal.

Figure 12:
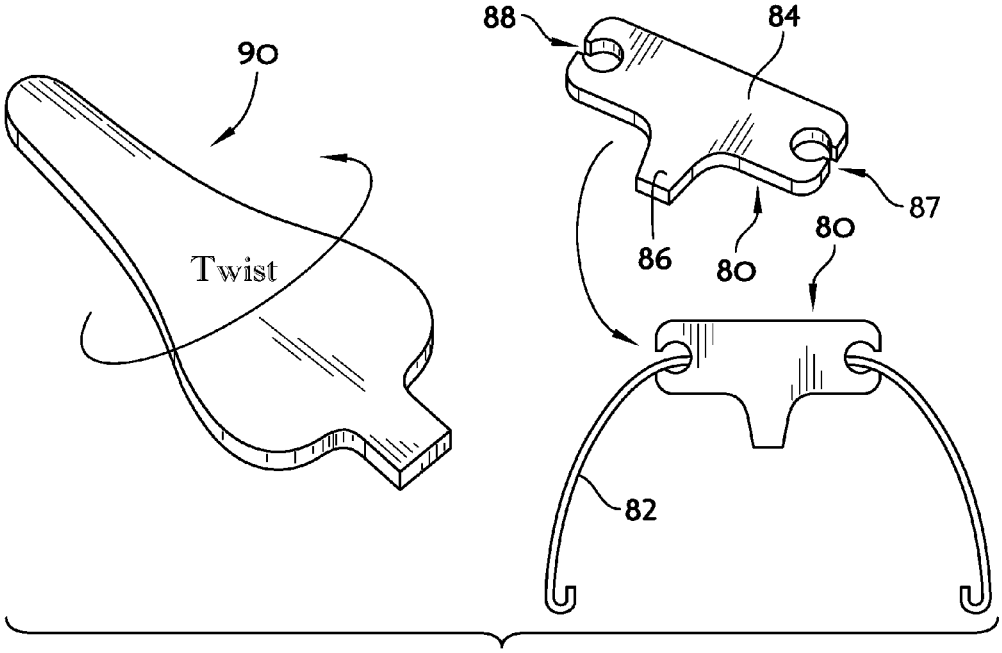
FIG. 12 is a side elevational view of a turn key handle that is configured to be clipped to the bail handle of a canister.
Figure 13:
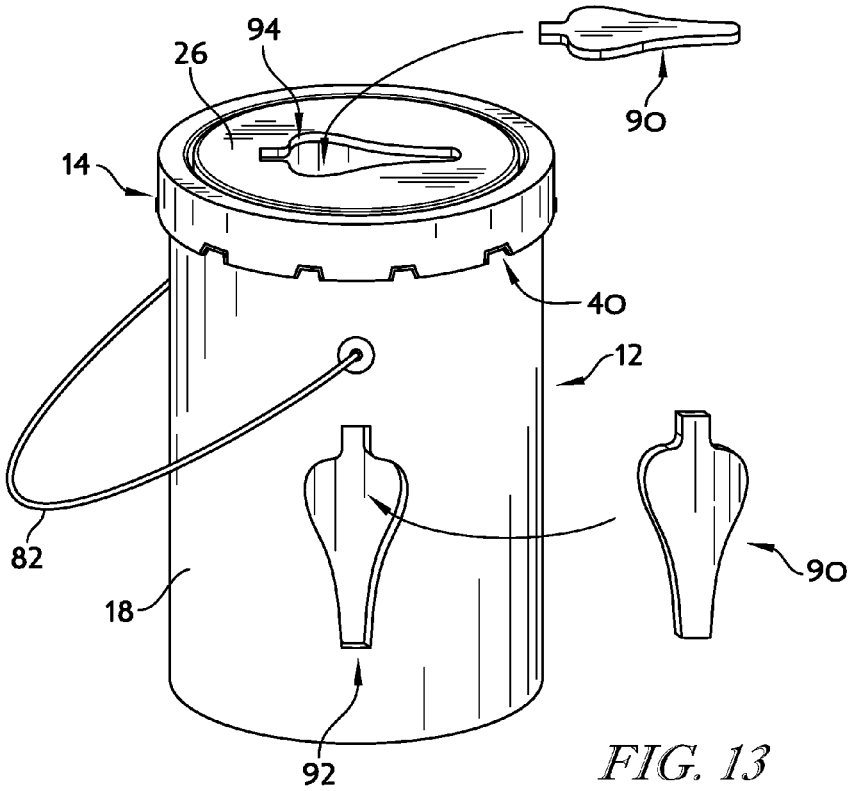
FIG. 13 is a perspective view of a canister with a container opener configured to be mounted on the side wall of the container.

Lids 14 can be stacked to facilitate storage and shipment. Lid 14 can be applied to containers in various ways including conventional snap-lid cappers. Lid 14 and container 12 are each made preferably from an all-plastic one piece construction. It is contemplated that child-resistant features can be added to lid 14. Various pry tools 80 and pry tool storage features are illustrated in FIGS. 12 and 13. It is contemplated that the pry tool 80 can be stored on a bail 82 of container 12 or in cavities 92, 94 formed in container 12 or lid 14.

Pry tool 80 can be configured to be coupled to bail 82 of container 12, as shown in FIG. 12. Pry tool 80 includes grip portion 84 and pry tab 86. Pry tab 86 is configured to be inserted into cut-outs 40 and twisted to pry outer wall 34 of annular rim 28. Grip portion 84 of pry tool 80 is formed to include openings 87 and 88 that permit grip portion 84 to be secured to bail 82 of container 12.

In another embodiment, side wall 18 of container 12 can be formed to include cavity 92 that is adapted to accept pry tool 90, as shown, for example, in FIG. 13. Cavity 92 is adapted to retain pry tool 90 to container 12 during shipment and permits pry tool 90 to be removed from cavity 92 to allow use to remove lid 14. Alternatively, top wall 26 of lid 14 can be formed to include cavity 94 that is adapted to accept pry tool 90. Cavity 94 is adapted to retain pry tool 90 to lid 14 during shipment and permits pry tool 90 to be removed from cavity 94 to allow use to removed lid 14 from container 12.

The invention claimed is:

1. A canister for containing a product comprising a container formed to include a mouth opening into a product receiving chamber and a side wall formed to include a neck finish, a lid adapted to mate with the neck finish of the container to close the opening into the product receiving chamber, the lid including an annular rim having an inner wall that engages with the neck finish of the container to form a first seal to seal the product receiving chamber, the annular rim of the lid also including an upper wall that engages with the neck finish of the container to form a second seal; and wherein the neck finish includes an inclined annular wall and an outwardly and horizontally extending lip coupled to an end of the inclined annular wall via an elbow located therebetween, the elbow biasing the outwardly and horizontally extending lip upwardly from a horizontal position and the outwardly and horizontally extending lip extending from an upper end of the inclined annular wall and terminating in a free end.

2. The canister of claim 1, wherein both the inner and upper walls of the annular rim include a gasket material.

3. The canister of claim 2, wherein the gasket material is injection molded onto the inner and upper walls of the lid.

4. The canister of claim 2, wherein the annular rim includes an outer wall that is coupled to an outer edge of the upper wall.

5. The canister of claim 4, wherein the outer wall includes a cut-out adapted to allow the lid to be pried from the container.

6. The canister of claim 4, wherein the outer wall includes inwardly extending bead segments that are positioned proximate a lower end of the outer wall.

7. The canister of claim 5, wherein the outer wall includes inwardly extending bead segments that are positioned proximate the cut-outs.

8. The canister of claim 6, wherein the canister includes a pry tool that when engaged with the annular rim causes the outer wall to flex outwardly to free at least one bead segment from the neck finish.

9. The canister of claim 4, wherein the inclined annular wall is positioned radially inwardly of the outer wall of the annular rim of the lid.

10. The canister of claim 1, wherein the neck finish includes an outwardly extending lock flange that interacts with the annular rim of the lid to retain the lid on the container.

11. The canister of claim 1, wherein the neck finish includes an outwardly extending annular bead that is positioned near a lower end of the inclined annular wall.

12. The canister of claim 1, wherein a retention groove is defined by the inclined annular wall, a lock flange, and an annular bead formed on the neck finish of the container.

13. The canister of claim 1, wherein the elbow is a flexible elbow adapted to bias the outwardly extending lip upwardly from horizontal.

14. The canister of claim 1, wherein the outwardly extending lip of the neck finish creates a pour stop that is used to prevent unwanted drips when pouring a product from the container.

15. A canister comprising a container formed to include a mouth opening into a product receiving chamber and a side wall formed to include a neck finish, the neck finish formed to include an inclined annular wall, an outwardly and horizontally extending lip that is coupled to an end of the inclined annular wall via an elbow located therebetween, the elbow biasing the outwardly and horizontally extending lip upwardly from a horizontal position and the outwardly and horizontally extending lip extending from an upper end of the inclined annular wall and terminating in a free end, a lid adapted to mate with the neck finish of the container to close the opening into the product receiving chamber, the lid including a top wall and an annular rim extending around a perimeter of the lid, the annular rim including an outer wall, and wherein the outwardly extending lip includes a first sealing surface that seals against the annular rim of the lid.

16. The canister of claim 15, wherein the elbow is a flexible elbow which biases the outwardly extending lip upwardly from horizontal.

17. The canister of claim 16, wherein the outwardly extending lip forms a first sealing surface that is adapted to engage the annular rim.

18. The canister of claim 16, wherein the flexible elbow includes an outer surface that forms a second sealing surface that is adapted to engage the annular rim.

19. The canister of claim 16, wherein the annular rim includes a gasket material that engages with an upper surface of the outwardly extending lip when the lid is mounted onto the container.

20. The canister of claim 15, wherein the neck finish of container includes a lock flange that extends radially outwardly from the inclined annular wall.

21. The canister of claim 20, wherein the lock flange includes a sloped surface that is adapted to engage the outer wall of the annular rim to cause outer wall to flex outwardly to permit annular rim to be secured to the lock flange.

22. The canister of claim 20, wherein the outer wall of the annular rim includes at least one bead segment that is adapted to be positioned beneath the lock flange when the lid is installed onto the container.

23. The canister of claim 22, wherein the neck finish also includes an outwardly extending annular bead that, along with the inclined annular wall and the lock flange form a bead retention groove that is adapted to accept the at least one bead segment when the bead segment is positioned beneath the lock flange.

24. The canister of claim 20, wherein the outer wall of the annular rim is formed to include at least one cut out that allows the outer wall of the annular rim to be freed from the lock flange of the container.

25. The canister of claim 18, wherein the elbow engages the annular rim of the lid to form a second sealing surface.

26. The canister of claim 24, wherein the canister includes a pry tool that when engaged with the cut out causes the outer wall to flex outwardly to free the annular rim from the neck finish.

27. A canister comprising a container formed to include a mouth opening into a product receiving chamber and a side wall formed to include a neck finish, the neck finish formed to include an inclined annular wall and a lip that is coupled via an elbow to the inclined annular wall, the lip extending radially outwardly and horizontally from an upper end of the inclined annular wall and terminating in a free end, the elbow biasing the outwardly and horizontally extending lip upwardly from a horizontal position, and the inclined annular wall including a locking flange that extends radially outwardly from the inclined annular wall in spaced relation to the lip, a lid adapted to mate with the neck finish of the container to close the opening into the product receiving chamber, the lid including an annular rim extending around a perimeter of the lid, the annular rim including a top wall and an outer wall, the outer wall including a bead segment that is adapted to be retained by the locking flange when the lid is installed onto the container, and wherein when the lip of the neck finish is engaged with the top wall of the annular rim a first seal is formed to seal the product receiving chamber.

28. The canister of claim 27, wherein the locking flange includes a sloped surface that is adapted to engage the bead segment during installation of the lid on the container to cause the outer wall to flex outwardly to permit the bead segment to be secured beneath the lock flange.

29. The canister of claim 27, wherein the elbow is configured to engage an inner wall of the annular rim to form a second seal that is positioned radially inwardly of the first seal.

30. The canister of claim 28, wherein the annular rim includes a gasket material that engages with an upper surface of the lip when the lid is mounted onto the container.

31. The canister of claim 28, wherein the elbow biases the lip upwardly from the horizontal to cause the lip to apply pressure to the top wall of the annular rim when the lid is mounted onto the container.

32. The canister of claim 27, wherein the outer wall of the annular rim is formed to include at least one cut out that allows the outer wall of the annular rim to be freed from the lock flange of the container.

33. The canister of claim 32, wherein the canister includes a pry tool that, when engaged with the cut out, causes the outer wall to flex outwardly to free the annular rim from the neck finish to permit removal of the lid from the container.

34. The canister of claim 27, wherein the lip of the neck finish creates a pour stop that is used to prevent unwanted drips when pouring a product from the container.

* * * * *